US005140779A

United States Patent [19]

Grois

[11] Patent Number: 5,140,779

[45] Date of Patent: Aug. 25, 1992

[54] OPTICAL FIBER POLISHING TOOL

[75] Inventor: Igor Grois, Lincolnwood, Ill.

[73] Assignee: Molex Incorporated, Lisle, Ill.

[21] Appl. No.: 608,925

[22] Filed: Nov. 5, 1990

[51] Int. Cl.[5] ..... B24B 41/06

[52] U.S. Cl. ..... 51/217 R; 51/217 P; 51/216 P

[58] Field of Search ..... 51/216 R, 217 R, 217 P, 51/217 L, 217 S, 216 P, 216 H, 216 LP, 283 R, 4, 109 R, 277, 125, 121

[56] References Cited

U.S. PATENT DOCUMENTS

| | | | |
|---|---|---|---|
| 4,492,060 | 1/1985 | Clark | 51/283 R |
| 4,498,260 | 2/1985 | Doty | 51/217 R |
| 4,539,776 | 10/1985 | Weaver, Jr. | 51/217 R |
| 4,693,035 | 9/1987 | Doyle | 51/277 |
| 4,776,136 | 10/1988 | Abendschein et al. | 51/216 P |
| 4,819,386 | 4/1989 | Struyf | 51/217 R |
| 4,905,415 | 3/1990 | Moulin | 51/216 LP |
| 5,018,316 | 5/1991 | Mulholland et al. | 51/277 |

*Primary Examiner*—Robert A. Rose

*Attorney, Agent, or Firm*—A. A. Tirva; Stephen Z. Weiss

[57] ABSTRACT

A polishing tool is provided for polishing the end faces of optical fibers encapsulated within connectors which terminate the optical fibers. The tool includes a housing which has a forward surface and spaced passageways extending thereinto from the forward surface for receiving a pair of connectors with the end faces of optical fibers, encapsulated within the connectors, exposed at the forward surface to permit the end faces to be polished by moving the housing over a polishing surface. A support member is disposed within the housing and includes through holes for supporting the connectors received in the passageways. A spring is disposed between an upper portion of the housing and the support member for normally biasing the support member and the connectors supported thereby forwardly in the passageways. The passageways are located on opposite sides of a line passing through the spring whereby the singular spring is operatively associated with both connectors and their optical fibers.

36 Claims, 2 Drawing Sheets

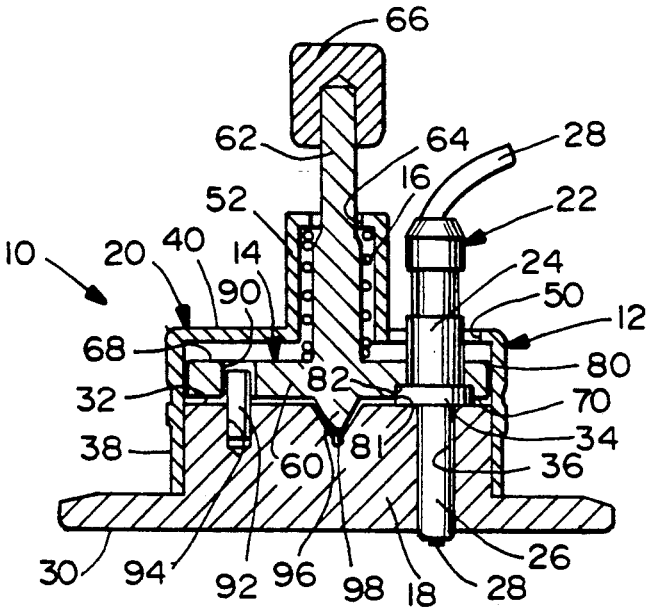
FIG.1
FIG.2
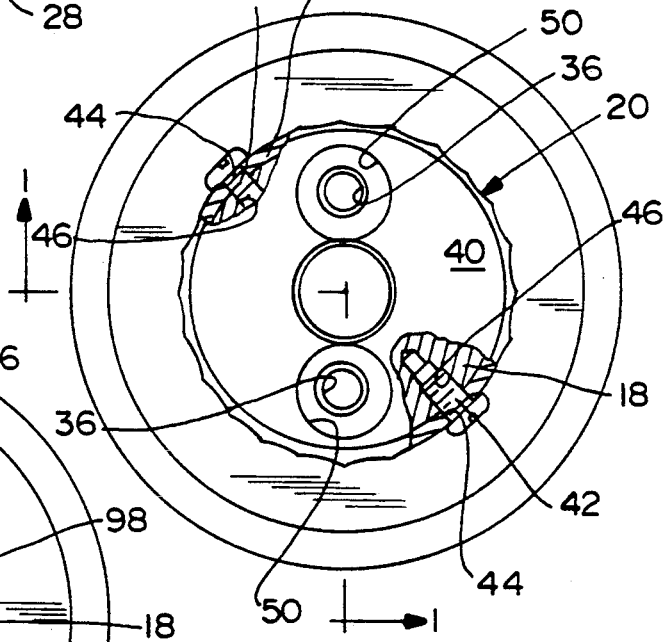
FIG.3
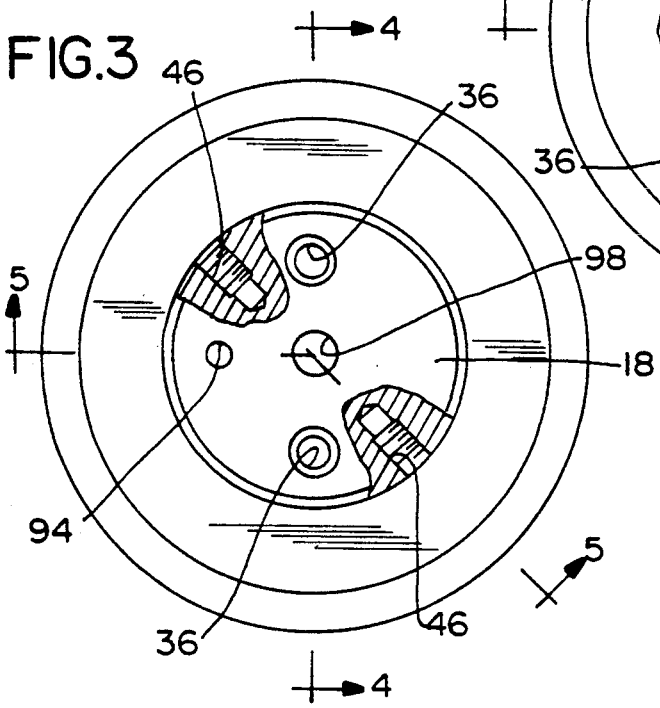

OPTICAL FIBER POLISHING TOOL

FIELD OF THE INVENTION

This invention generally relates to the art of optical fibers and, particularly, to a tool for polishing the end faces of optical fibers.

BACKGROUND OF THE INVENTION

In the optical fiber art, lightguide fibers are used in optical transmission systems wherein the fibers are connected end-to-end to transfer light therebetween. The fibers usually are terminated in connectors which center the fibers to provide low insertion losses. The connectors are coupled together so that their encapsulated fibers connect end-to-end.

Optical fiber connectors often include a connector body, a forwardly projecting ferrule of ceramic or other rigid material, and a connecting member for coupling the connector to a complementary connector. The fiber projects slightly from the distal end of the ferrule when manufactured.

Signal loss can be encountered because light is lost if the end faces of the connected fibers are separated at a gap or because light diverges as it radiates from one or both of the fibers. Consequently, it has become conventional and necessary to polish the end faces of the fibers which protrude beyond the connector ferrules after manufacture and prior to incorporation of the connectors into an optical fiber transmission system.

The fiber ends can be polished with precision by precise machines in manufacturing environments. However, there is a considerable need for polishing fibers in the field for installation, replacement or repair purposes, i.e., hand tools for field technicians. There are few such polishing tools available. Examples of such hand tools are shown in U.S. Pat. Nos. 4,539,776, to Weaver, Jr., dated Sep. 10, 1985, and 4,776,136 to Abendschein et al., dated Oct. 11, 1988. The tools shown in both of these patents are designed to polish the end face of a single fiber encapsulated in a fiber optic connector which is held by the tool. Both tools include resilient means to bias the fiber optic connector and the end face of the fiber forwardly toward an appropriate polishing surface. Since the tools are designed to hold a single connector and its fiber, it can be understood that when coupling a pair of fiber sections end-to-end, the polishing procedure must be repeated at least twice.

It would be desirable to provide a tool which can polish at least a pair of fibers simultaneously, but problems are encountered in applying resilient forces to the held connectors/fibers. Since the tool is moved over a polishing surface, if independent resilient means were provided for the two fibers, nonuniform polishing of the fiber ends would result. This invention is directed to solving such problems and satisfying a need for a hand polishing tool which accommodates at least a pair of fiber optic connectors and their fibers, with a single resilient means operatively associated with both fibers.

SUMMARY OF THE INVENTION

An object, therefore, of the invention is to provide a new and improved polishing tool for polishing the end faces of optical fibers encapsulated within connectors which terminate the optical fibers.

In the exemplary embodiment of the invention, the polishing tool includes housing means having a forward surface and at least a pair of spaced passageways extending thereinto from the forward surface for receiving a pair of connectors. The end faces of optical fibers encapsulated within the connectors are exposed at the forward surface to permit the end faces to be polished by moving the housing means over a polishing surface. Support means are provided on the housing means for supporting the connectors received in the passageways.

The invention contemplates singular resilient means operatively associated between the housing means and the support means for normally biasing the support means and the connectors supported thereby forwardly in the passageways. The resilient means are located such that an area of the support means about one passageway can move against the resilient means away from the forward surface without an area of the support means about the other passageway moving away from the forward surface. Therefore, the connectors are independently yieldable on contact with the polishing surface against the singular resilient means. In the preferred embodiment, the passageways in the housing means are located on opposite diametral sides of a single coil spring.

As disclosed herein, the housing means include a base through which the passageways extend. The base defines the forward surface of the housing means and includes a rearward surface. The support means has a forward side and a rearward side. The forward side is juxtaposed to the rearward surface of the base and the rearward side is operatively associated with the resilient means. The housing means also include a cover secured to the base and surrounding the support means. The resilient means is disposed between the cover and the rearward side of the support means.

Another feature of the invention is the provision of locking means on the support means for locking the connectors in the passageways. In particular, the cover has apertures aligned with the passageways in the base and through which the connectors are inserted thereinto. The support means has holes aligned with the passageways in the base and the apertures in the cove and through which the connectors extend. The support means is rotatable relative to the housing means. The holes are keyhole shaped with enlarged portions alignable with the passageways in the base and the apertures in the cover to permit insertion of the connectors. The support means is rotatable to angularly move narrow portions of the keyhole shaped holes into locking engagement with flange means on the connectors to prevent removal of the connectors. Still further, stop means are provided between the support means and the housing means to limit the degree of rotation of the support means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 1 is a vertical section through the polishing tool of the invention, taken generally along right-angled line 1—1 in FIG. 2;

FIG. 2 is a top plan view of the polishing tool, partially broken away to show the means for securing the cover portion and base portion of the housing together;

FIG. 3 is a top plan view of the base portion of the housing;

DETAILED DESCRIPTION OF THE PREFERRED EMBODIMENT

Figure 4:
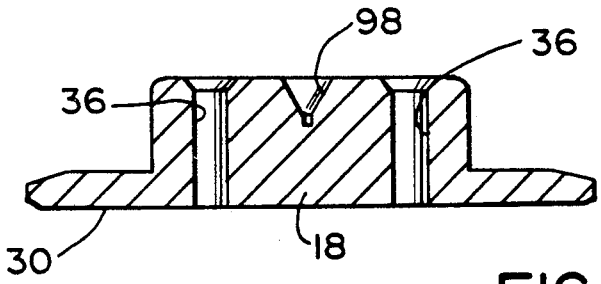
FIG. 4 is a vertical section taken generally along line 4—4 of FIG. 3.

Referring to the drawings in greater detail, and first to FIG. 1, a hand manipulatable polishing tool, generally designated 10, is designed for polishing the end faces of a pair of optical fibers encapsulated within a pair of connectors which terminate the optical fibers. Although the tool is designed for polishing more than one optical fiber, the tool is not limited to polishing only a pair of fibers.

Polishing tool 10 generally includes housing means, generally designated 12, connector support means, generally designated 14, disposed within and surrounded by the housing means, and resilient means in the form of a coil spring 16 operatively associated between the housing means and the support means. The housing means include a base portion 18 and a cover, generally designated 20. The tool receives, supports and locks a pair of fiber optic connectors, generally designated 22, although only one connector is shown in FIG. 1 because of the direction in which the sectional depiction is taken along right-angled section line 1—1 in FIG. 2.

Suffice it to say, fiber optic connector 22 includes a body 24 and a forwardly projecting ferrule 26 of ceramic or other hard material. A fiber optic cable 28 is encapsulated within connector 22, with a length of an optical fiber, stripped of its cladding, extending through ferrule 26 so as to slightly project from the distal end of ferrule 26, as with fiber end 28 shown in FIG. 1.

Base portion 18 of housing means 12 includes an enlarged forward surface 30 beyond which the distal ends of connector ferrules 26 and fiber ends 28 protrude. The enlarged forward surface is moved over an appropriate polishing surface (not shown) to permit the tiny end faces of the optical fibers to be polished in common horizontal planes when the enlarged forward surface is moved over the polishing surface. Base portion 18 also includes a rearward surface 32 against which a flange 34 of each connector 22 is held by engagement with support means 14, as biased forwardly by coil spring 16. Base portion 18 also has a pair of passageways 36 (also see FIG. 4) through which connector ferrules 26 extend.

Figure 5:
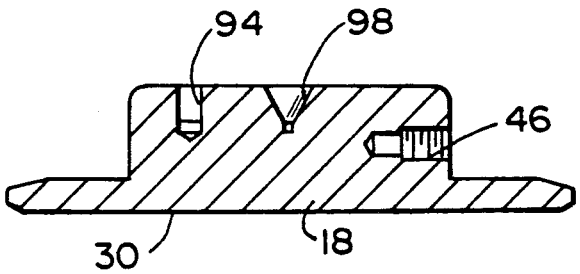
FIG. 5 is a vertical section taken generally along line 5—5 of FIG. 3.

Cover 20 includes a cylindrical depending side wall 38 and a flat top wall 40. Cylindrical side wall 38 surrounds the upper part of base portion 18 and is secured thereto by a pair of appropriate bolts 42 (FIG. 2) extending through holes 44 in cover side wall 38 and into threaded bores 46 (also see FIGS. 3 and 5) in base portion 18. Cover 20 also includes a pair of apertures 50 in top wall 40 through which connectors 22 are inserted into the tool. Lastly, cover 20 includes an upwardly projecting hollow boss 52 within which coil spring 16 is disposed so to be operatively associated between the cover (i.e., the housing means) and support means 14 as described below.

Support means 14 include a disc-shaped body portion 60 with an integral upwardly projecting stem 62 protruding through a hole 64 in the top of hollow boss 52 of cover 20. Hole 64 is sufficiently larger than the cross-dimensions of stem 62 to allow teetering movement of body portion 60 as described below. A manually graspable knob 66 is press-fit onto the top of stem 62. It can be seen in FIG. 1 that coil spring 16 is compressed and sandwiched between a rearward side 68 of body portion 60 and the inside of the top of boss 52. Body portion 60 has a forward side 70 juxtaposed with rearward surface 32 of base portion 18. Body portion 60 of support means 14 has a pair of through holes 74 (FIG. 6) aligned with passageways 36 in base portion 18 and apertures 50 in cover 20 and through which connectors 22 are inserted into the polishing tool to the position shown in FIG. 1.

Means are provided for locking connectors 22 in the tool, particularly within passageways 36 of base portion 18. More particularly, referring to FIG. 6 in relation to Figure holes 74 in body portion 60 of support means 14 are elongated by narrowed portions 80 so to be generally keyhole shaped. A stepped recess 81 in forward side 70 of body 60 defines a ledge 82 which can be seen in both FIGS. 1 and 6. The recess is approximately the same diameter as through hole 50 and is of a size slightly larger than flange 34 of a connector 22. Consequently, through hole 74 is large enough for flange 34 to pass therethrough to the position shown in FIG. 1 wherein the flange is below narrowed portion 80. Upon rotation of support means 14, as by a technician grasping knob 66, the support means is rotated in the direction of arrows "A" (FIG. 6) to bring flange 34 of the connector into recess 81 and into registry with ledge 82, the body portion 24 of the connector being narrow enough to move through narrowed portion 80.

Therefore, it can be seen that what is depicted in FIG. 1, is the connector locked in position whereby flange 34 of connector 22 abuts ledge 82 so that any pressure applied to fiber end 28 and/or the distal end of ferrule 26 will cause support means 14 to move upwardly against the biasing of coil spring 16.

Figure 6:
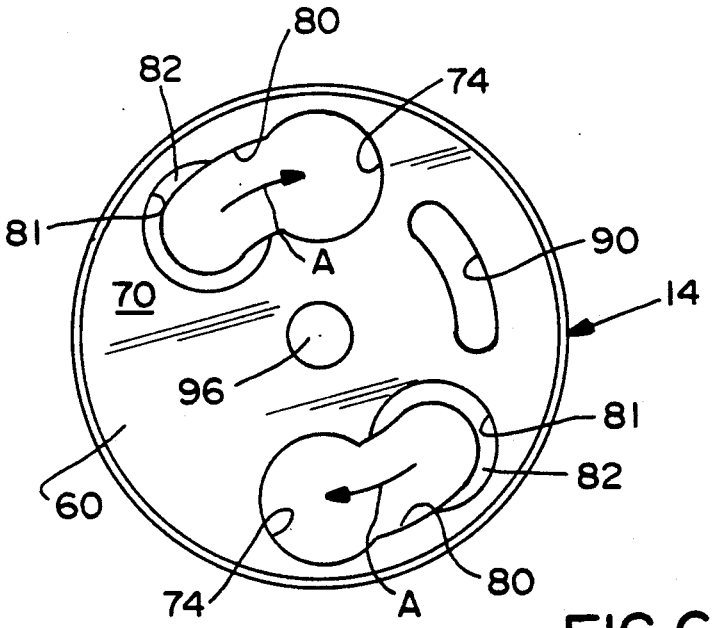
FIG. 6 is a bottom plan view, on a reduced scale of the connector support means within the housing of the tool.

Stop means are provided between support means 14 and base portion 18 of housing means 20 to limit the degree of rotation of the support means. More particularly, as shown in FIG. 6, an arcuately shaped, elongated slot 90 is provided through body portion 60 of the support means. Referring back to FIG. 1, it can be seen that a pin 92 fixed within a recess 94 of base portion 18 projects upwardly into elongated arcuate slot 90. The opposite ends of slot 90 define stop means for abutment by pin 92, and the distance or degree of rotation afforded by the slot is equal to the angular rotation of support means 14 to lock the connector under ledge 82 after it has been inserted into the tool through holes 74 in body portion 60 of the support means.

It can be seen in the drawings that provision is made for a pair of connector 22 to be disposed on opposite sides of the resilient means afforded by coil spring 16. In the disclosed embodiment, the coil spring is located at the center of the tool, and the apertures 50 in cover 20, through holes 74 in support means 14 and passageways 36 in base portion 18 are on opposite diametral sides of the center spring.

In addition, as seen in FIG. 1, a cone-shaped boss 96 projects downwardly from body portion 60 of support means 14 and into a cone-shaped recess 98 in the rearward surface 32 of base portion 18. The boss and receiving recess precisely center the support means relative to the housing means; precisely align through holes 74 with apertures 50 and passageways 36 to facilitate insertion of the connectors; and facilitate rotation of the support means. Although not precisely evident from the scale of the depiction of the drawings, the sides of cone-shaped recess 98 diverge slightly more than the sides of cone-shaped boss 96 to provide an amount of clearance therebetween.

With the above-described structure, including the disposition of the connectors on opposite sides of the resilient means afforded by coil spring 16, the coil spring normally will exert equal forces onto the connectors and, in turn, the fiber ends 28 against a polishing surface. However, should a technician apply downward pressure on the tool which is not in an absolute vertical line (or perpendicular to the polishing surface), and area of body portion 60 about one of the connectors or about one of the passageways 36 can move against the coil spring away from the polishing surface without an area of the support means about the other connector or other passageway moving away from the polishing surface. Therefore, the connectors are independently yieldable on contact with the polishing surface. The combined structure of the tool, particularly the singular resilient means and the location of the connectors thereabout, afford equal polishing of both fiber ends and accommodate nonuniform pressure about the horizontal area of the tool which otherwise could not possibly be accomplished if each connector was under the influence of separate resilient or biasing means.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A polishing tool for polishing the end faces of optical fibers encapsulated within connectors which terminate the optical fibers, comprising:

housing means having a forward surface and at least a pair of spaced passageways extending thereunto from the forward surface for receiving a pair of connectors with the end faces of optical fibers, encapsulated within the connectors, exposed at the forward surface to permit the end faces to be polished by moving the housing means over an appropriate polishing surface;

support means on the housing means for supporting the connectors received in said passageways; and a singular resilient means operatively associated between the housing means and the support means for normally biasing the support means and the connectors supported thereby forwardly in the passageways, the resilient means being located such that an area of the support means about one passageway can move against the resilient means away from the polishing surface without an area of the support means about the other passageway moving away from the forward surface whereby the connectors are independently yieldable on contact with the polishing surface.

2. The polishing tool of claim 1 wherein said passageways are located on opposite sides of a line passing through said resilient means.

3. The polishing tool of claim 2 wherein said passageways are located on diametrical opposite sides of said resilient means.

4. The polishing tool of claim 2 wherein said resilient means comprise a coil spring.

5. The polishing tool of claim 1 wherein said housing means include a base through which the passageways extend, the base defining said forward surface and including a rearward surface, said support means having a forward side and a rearward side, the forward side being juxtaposed to the rearward surface of the base and the rearward side being operatively associated with the resilient means.

6. The polishing tool of claim 5 wherein said housing means include a cover secured to the base and surrounding the support means, the resilient means being operatively associated between the cover and the rearward side of the support means.

7. The polishing tool of claim 6 wherein said support means include a stem extending through the cover, said resilient means comprising a coil spring surrounding the stem within the cover.

8. The polishing tool of claim 6, including means removably securing the cover to the base.

9. The polishing tool of claim 6 wherein said cover includes apertures aligned with the passageways in the base and through which the connectors are inserted thereinto.

10. The polishing tool of claim 9 wherein said support means include means for locking the connectors in the passageways.

11. The polishing tool of claim 10 wherein said locking means include abutment means engaging the connectors in a forward direction whereby pressure from the polishing surface pushes the connectors against the support means and, in turn, against the resilient means.

12. The polishing tool of claim 1 wherein said housing means include a base through which the passageways extend and a cover secured to the base and surrounding the support means, the resilient means being operatively associated between the cover and the support means.

13. The polishing tool of claim 12 wherein said cover includes apertures aligned with the passageways in the base and through which the connectors are inserted thereinto.

14. The polishing tool of claim 13 wherein said support means include through holes aligned with the passageways in the base and the apertures in the cover and through which the connectors extend.

15. The polishing tool of claim 14 wherein said support means include means for locking the connectors in the passageways.

16. The polishing tool of claim 15 wherein said support means include manually manipulatable means extending through the cover for rotating the support means relative to the housing means, said locking means being operative in response to rotation of the support means.

17. The polishing tool of claim 16 wherein said locking means comprise said holes being keyhole shaped with enlarged portions alignable with the passageways in the base and the apertures in the cover to permit insertion of the connectors, and with narrow portions movable into locking engagement with the connectors in response to rotation of the support means to prevent removal of the connectors.

18. The polishing tool of claim 16, including stop means between the support means and the housing means to limit the degree of rotation of the support means.

19. The polishing tool of claim 16 wherein said manually manipulatable means comprise a stem extending through the cover.

20. The polishing tool of claim 19 wherein said resilient means comprise a coil spring surrounding the stem within the cover.

21. A polishing tool for polishing the end faces of optical fibers encapsulated within connectors which terminate the optical fibers, comprising:

housing means including a base and a cover secured to the base, the base having a forward surface and at least a pair of spaced passageways extending thereunto from the forward surface for receiving a pair of connectors with the end faces of optical fibers, encapsulated within the connectors, exposed at the forward surface to permit the end faces to be polished by moving the housing means over an appropriate polishing surface, the cover having apertures aligned with the passageways in the base and through which the connectors are inserted thereunto;

support means in the housing means and surrounded by the cover for supporting the connectors received in said passageways; and a singular resilient means between the cover and the support means for normally biasing the support means and the connectors supported thereby forwardly in the passageways, the resilient means being located between the passageways so that the connectors are located on opposite sides of a line passing through the resilient means.

22. The polishing tool of claim 21 wherein said passageways are located on diametrical opposite sides of said resilient means.

23. The polishing tool of claim 21 wherein said resilient means comprise a coil spring.

24. The polishing tool of claim 21 wherein said support means include a steam extending through the cover, said resilient means comprising a coil spring surrounding the stem within the cover.

25. The polishing tool of claim 21, including means removably securing the cover to the base.

26. The polishing tool of claim 21 wherein said cover includes apertures aligned with the passageways in the base and through which the connectors are inserted thereinto.

27. The polishing tool of claim 26 wherein said support means include means for locking the connectors in the passageways.

28. The polishing tool of claim 27 wherein said locking means include abutment means engaging the connectors in a forward direction whereby pressure from the polishing surface pushes the connectors against the support means and, in turn, against the resilient means.

29. The polishing tool of claim 21 wherein said cover includes apertures aligned with the passageways in the base and through which the connectors are inserted thereinto.

30. The polishing tool of claim 29 wherein said support means include through holes aligned with the passageways in the base and the apertures in the cover and through which the connectors extend.

31. The polishing tool of claim 30 wherein said support means include means for locking the connectors in the passageways.

32. The polishing tool of claim 31 wherein said support means include manually manipulatable means extending through the cover for rotating the support means relative to the housing means, said locking means being operative in response to rotation of the support means.

33. The polishing tool of claim 32 wherein said locking means comprise said holes being keyhole shaped with enlarged portions alignable with the passageways in the base and the apertures in the cover to permit insertion of the connectors, and with narrow portions movable into locking engagement with the connectors in response to rotation of the support means to prevent removal of the connectors.

34. The polishing tool of claim 32, including stop means between the support means and the housing means to limit the degree of rotation of the support means.

35. The polishing tool of claim 21 wherein said support means include a cone-shaped boss on a forward side thereof projecting into a cone-shaped recess in a rearward surface of the base.

36. The polishing tool of claim 35 wherein said cone-shaped recess diverges at a greater angle than the cone-shaped boss so that an apex of the cone-shaped boss seats in the bottom of the cone-shaped recess.

* * * * *